US008834211B2

(12) United States Patent
Sommer

(10) Patent No.: US 8,834,211 B2
(45) Date of Patent: Sep. 16, 2014

(54) GROUNDING APPARATUS AND GROUNDING SYSTEMS INCLUDING THE SAME FOR METER ENCLOSURE MOUNTING

(71) Applicant: Eaton Corporation, Cleveland, OH (US)

(72) Inventor: David Roger Sommer, Bloomington, IL (US)

(73) Assignee: Eaton Corporation, Cleveland, OH (US)

( * ) Notice: Subject to any disclaimer, the term of this patent is extended or adjusted under 35 U.S.C. 154(b) by 71 days.

(21) Appl. No.: 13/688,590

(22) Filed: Nov. 29, 2012

(65) Prior Publication Data

US 2014/0148065 A1 May 29, 2014

(51) Int. Cl.

*H01R 4/36* (2006.01)
*H01R 4/64* (2006.01)
*H01R 9/24* (2006.01)

(52) U.S. Cl.

CPC .. *H01R 4/36* (2013.01); *H01R 9/24* (2013.01); *H01R 4/646* (2013.01)
USPC ..... 439/814

(58) Field of Classification Search

USPC ..... 439/793, 810, 814
See application file for complete search history.

(56) References Cited

U.S. PATENT DOCUMENTS

| | | | | |
|---|---|---|---|---|
| 5,030,131 | A * | 7/1991 | Boehm | 439/387 |
| 5,957,733 | A * | 9/1999 | Mello et al. | 439/814 |
| 6,443,783 | B1 * | 9/2002 | Beadle | 439/814 |
| 7,056,163 | B2 * | 6/2006 | Hay | 439/810 |
| 7,142,412 | B2 * | 11/2006 | Witherbee et al. | 361/662 |
| 7,232,775 | B1 * | 6/2007 | Scaringe et al. | 439/810 |
| 7,438,607 | B2 * | 10/2008 | Fong | 439/810 |
| 7,445,527 | B1 * | 11/2008 | Carr | 439/814 |
| 7,632,160 | B2 * | 12/2009 | Corry et al. | 439/814 |
| 7,883,382 | B2 | 2/2011 | Howard et al. | |
| 7,927,156 | B2 * | 4/2011 | Appel et al. | 439/709 |
| 7,997,944 | B1 * | 8/2011 | Federowicz | 439/814 |
| 2005/0202732 | A1 * | 9/2005 | Rizzo et al. | 439/810 |

* cited by examiner

*Primary Examiner* — Neil Abrams
*Assistant Examiner* — Travis Chambers
(74) *Attorney, Agent, or Firm* — Eckert Seamans Cherin & Mellott, LLC; Carol A. Marmo

(57) ABSTRACT

The invention includes a grounding system which includes a grounding apparatus, a first ground conductor and a plurality of second ground conductors. The grounding apparatus includes a substrate and an elongated conductive member. The substrate has formed therein an aperture for receiving and electrically and mechanically engaging the first ground conductor. The elongated conductive member is mounted to a surface of the substrate and includes a plurality of lugs structured to receive and electrically and mechanically engage the plurality of second ground conductors. The substrate is structured for mounting to an exterior surface of a meter enclosure.

10 Claims, 4 Drawing Sheets

GROUNDING APPARATUS AND GROUNDING SYSTEMS INCLUDING THE SAME FOR METER ENCLOSURE MOUNTING

BACKGROUND

1. Field

The disclosed concept pertains generally to grounding systems for mounting on a meter enclosure or disconnecting means. More particularly, the grounding systems include a first grounding conductor, a plurality of second grounding conductors and a grounding apparatus. The grounding apparatus is structured to receive and electrically and mechanically engage the first and second grounding conductors.

2. Background Information

It is known to employ a neutral bar or ground bar to provide a common point for termination of a plurality of neutral or bonding conductors rand one ground conductor in a panelboard or load center. Each of at plurality of screw terminals electrically and mechanically engages one end of a corresponding neutral or ground conductor.

The 2008 National Electric Code (NEC) Section 250.94 provides the requirements for intersystem bonding termination, Under NEC 250.94, intersystem bonding and grounding connectors are to be provided external to enclosures at the service equipment and at the disconnecting mechanisms for any additional buildings or structures. Such an intersystem bonding termination device does not interfere with opening a service or metering equipment enclosure. Also, the intersystem bonding termination device has the capacity for connection of not less than three intersystem bonding conductors. NEC 250.94 covers, for example, bonding telephone, cable television (CATV) and satellite to a home's grounding system.

There is provided in the art various apparatus and kits to address the requirements of NEC 250.94. These kits are typically mounted within an electrical service enclosure. There are disadvantages associated with mounting, e.g., clamping a kit directly onto a meter socket box. For example, the kit damages the paint on the meter socket box and needs sealant to prevent the box from rusting. Also, since meter socket boxes come in many different sizes, the installer has to stock multiple different kit sizes.

There is room for improvement in grounding systems employing a grounding apparatus and, in particular, for grounding systems suitable for mounting on meter enclosures.

SUMMARY

These needs and others are met by embodiments of the disclosed concept.

In accordance with one aspect of the disclosed concept, there is provided a grounding apparatus including a substrate having a top surface and a bottom surface, and a first aperture formed therein being structured to receive and electrically and mechanically engage the end portion of the grounding conductor. The grounding apparatus further includes an elongated conductive member mounted to the top surface of the substrate. The elongated conductive member includes a first end, an opposite second end, and an intermediate portion disposed between the first end and the opposite second end. The intermediate portion includes a plurality of lugs. Each of the plurality of lugs is structured to receive and electrically and mechanically engage the end portion of a corresponding one of the plurality of second grounding conductors. The bottom surface of the substrate is structured for mounting to an exterior surface of a meter enclosure or disconnecting means.

In accordance with one aspect of the disclosed concept, there is provided a grounding system including a first grounding conductor, a plurality of second grounding conductors and a grounding apparatus. The first grounding conductor and each of the plurality of second grounding conductors have an end portion. The grounding apparatus includes a substrate having a top surface and a bottom surface, and a first aperture formed therein being structured to receive and electrically and mechanically engage the end portion of the grounding conductor. The grounding apparatus further includes an elongated conductive member mounted to the top surface of the substrate. The elongated conductive member includes a first end, an opposite second end, and an intermediate portion disposed between the first end and the opposite second end. The intermediate portion includes a plurality of lugs. Each of the plurality of lugs is structured to receive and electrically and mechanically engage the end portion of a corresponding one of the plurality of second grounding conductors. The bottom surface of the substrate is structured for mounting to an exterior surface of a meter enclosure or disconnecting means.

The elongated conductive member may include a planar surface and the intermediate portion may include a plurality of second apertures disposed through the planar surface for mounting the elongated conductive member to the substrate.

Each of the plurality of lugs may include a first threaded opening for receiving a first threaded screw lug. Each of the plurality of lugs may be structured to receive the end portion of the corresponding one of the plurality of second grounding conductors, in order that the corresponding one of the plurality of second grounding conductors extends transverse to the elongated conductive member.

The elongated conductive member may include an open jaw lug having a second threaded opening for receiving a second threaded screw lug.

The first grounding conductor may be disposed in a tube having an end portion. The first aperture in the substrate may be structured to receive and electrically and mechanically engage the end portion of the tube.

The meter enclosure can have an exterior top surface, an exterior bottom surface and two exterior side surfaces, and the bottom surface of the substrate may be mounted onto one of the exterior surfaces of the meter enclosure. In certain embodiments, the bottom surface of the substrate may be mounted onto the exterior bottom surface of the meter enclosure or disconnecting means.

At least one of the first aperture and the tube may have as threaded connector mechanism disposed thereon for receiving and electrically and mechanically engaging the tube into the first aperture.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
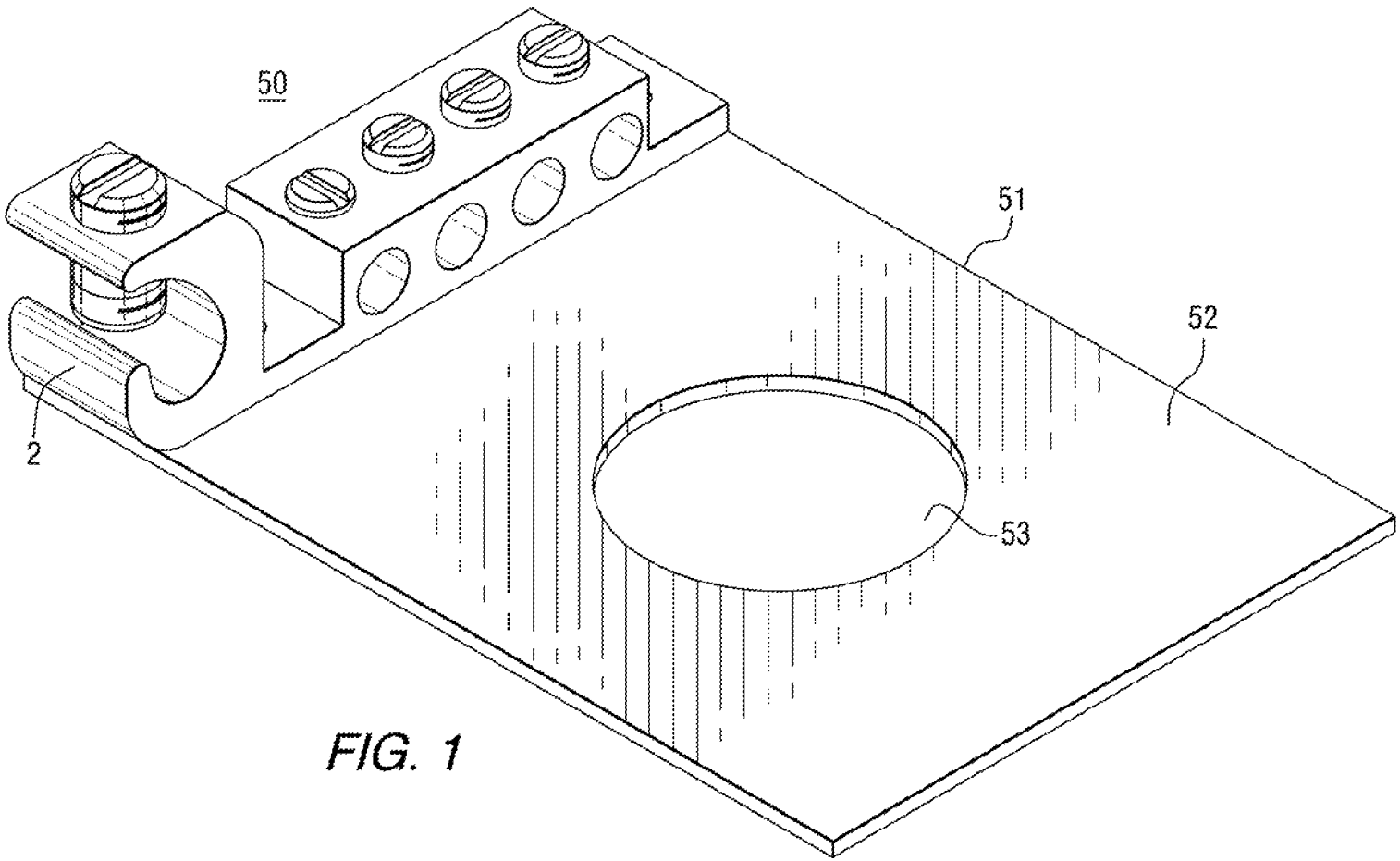
FIG. 1 is an isometric view of a grounding apparatus including a substrate and an elongated conductive member, in accordance with certain embodiments of the disclosed concept.

The disclosed concept relates to an intersystem bonding termination for connecting intersystem bonding and grounding conductors required for other systems. The intersystem bonding termination is provided external to enclosures at the service equipment and at the disconnecting means for any additional buildings or structures. Further, the disclosed concept relates to a set of terminals securely mounted to the meter enclosure or disconnecting means, and electrically connected thereto in accordance with the requirements of 2008 NEC Article 250.94.

For ease of description, the disclosed concept is described herein in association with grounding systems including a mounting surface, a first grounding conductor, a plurality of other second grounding conductors and a grounding apparatus, for mounting on an exterior surface of a meter enclosure. However, it is understood and contemplated that the disclosed concept is applicable to a wide range of intersystem bonding termination devices and systems for connecting intersystem bonding and grounding conductors required for other systems grounding systems wherein the intersystem bonding termination device or system is external to enclosures at the service equipment and at the disconnecting means for any additional buildings or structures. Thus, the disclosed concept encompasses these various embodiments. For example, as used herein, the term "meter enclosure(s)" encompasses disconnecting means, service equipment and metering enclosure(s).

In certain embodiments of the disclosed concept, the grounding apparatus includes a substrate and an elongated conductive member. The substrate has a top surface and a bottom surface. The elongated conductive member is mounted on one of the top and bottom surfaces of the substrate and the other surface of the substrate is mounted on an exterior surface of a meter enclosure. The surface of the substrate can be mounted on various surfaces of the meter enclosure including one of an exterior top surface, an exterior bottom surface, an exterior back surface and two exterior side surfaces of the meter enclosure. In certain embodiments, the surface of the substrate is mounted on a bottom exterior surface of the meter enclosure.

The mechanism for mounting the elongated conductive member to the substrate surface and the other substrate surface to the meter enclosure surface can vary and can include conventional fastening mechanisms known in the art for coupling or connecting a surface of one substrate to the surface of another substrate. In certain embodiments, fasteners, such as but not limited to bolts, screws and the like are used and the surface(s) includes corresponding apertures formed therein to receive the fasteners. Further, the fasteners used to mount the elongated conductive member to the substrate can penetrate through the thickness of the substrate to also fasten the substrate to the exterior surface of the meter enclosure.

The substrate includes an aperture formed therein which is structured to receive and electrically and mechanically engage an end portion of the first grounding conductor. The first grounding conductor extends perpendicular to the surface of the substrate. The design and characteristics of the first grounding conductor can vary. In certain embodiments, the first grounding conductor includes a ground wire constructed of copper or aluminum or copper-clad aluminum. Further, in certain embodiments, the first grounding conductor can include a #14 AWG wire and larger or a #2 AWG wire and smaller. Furthermore, in certain embodiments, the first grounding conductor may be encompassed by or disposed in a tube or covering. The aperture formed in the substrate can be structured to receive an end portion of the tube or covering.

The elongated conductive member includes a first end, an opposite second end, and an intermediate portion disposed between the first end and the opposite second end. The intermediate port on includes a plurality of lugs. Each of the plurality of lugs is structured to receive and electrically and mechanically engage an end portion of a corresponding one of the plurality of second grounding conductors, in order that the corresponding second grounding conductors extend transverse to the elongated conductive member. Each of the plurality of lugs may include a first threaded opening for receiving as fast threaded screw lug.

The intermediate portion further includes a plurality of mounting apertures. The elongated conductive member may include a planar surface and the mounting apertures may be disposed through the planar surface. Each of the mounting apertures may be structured to receive a fastener mechanism for the purpose of mounting the elongated conductive member to the substrate and optionally, the substrate to the exterior surface of the meter enclosure.

The intermediate portion may be a ground bar including a first one of the plurality of mounting apertures, the plurality of lugs, and a second one of the plurality of mounting apertures disposed along the elongated conductive member.

In certain embodiments of the disclosed concept, the elongated conductive member may further include an open jaw lug having a second threaded opening for receiving a second threaded screw lug. The open jaw lug is structured to receive and electrically and mechanically engage a portion of another grounding conductor, extending traverse to the elongated conductive member. The open jaw lug can be adjusted to form a variety of sized knockouts.

The elongated conductive member may have a first thickness at about each of the plurality of mounting apertures and a second thickness at the intermediate portion, wherein the second thickness is greater than the first thickness. In certain embodiments including an open jaw lug, the elongated conductive member may have a third thickness at the open jaw lug, wherein the third thickness is greater than the second thickness and the second thickness is greater than the first thickness.

The disclosed concept allows the convenience of having the grounding apparatus and grounding conductor directly coupled or connected to the meter enclosure by mounting of a single substrate on an exterior surface of the meter enclosure.

Referring to FIG. 1, a grounding apparatus 50 is shown which includes an elongated conductive member 2 and a substrate 51. The elongated conductive member 2 is mounted to a top surface 52 of the substrate 51. A first aperture 53 is formed in the substrate 51. The first aperture 53 is structured to receive and electrically and mechanically engage a first ground conductor (not shown).

Figure 2:
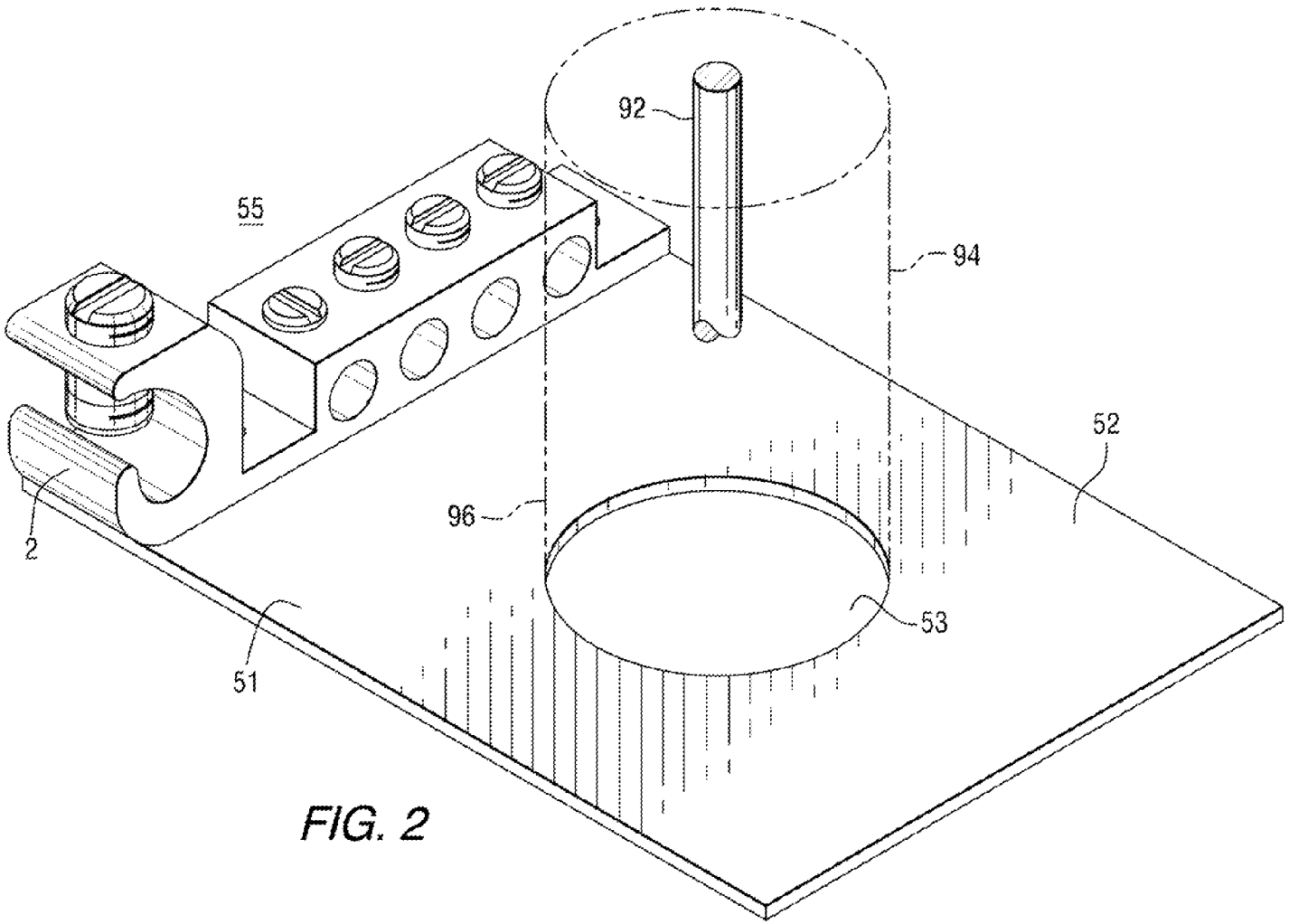
FIG. 2 is an isometric view of a grounding system including the grounding apparatus of FIG. 1 and a grounding conductor, in accordance with certain embodiments of the disclosed concept.

Referring to FIG. 2, a grounding system 55 is shown which includes the grounding apparatus 50 shown in FIG. 1 and further includes a first grounding conductor 92. The first grounding conductor 92 is disposed within a tube 94 (shown in phantom line drawing in FIG. 2) having an end portion 96. The first aperture 53 is structured to receive and electrically and mechanically engage the end portion 96 of the tube 94. In certain embodiments, the tube 94 and/or the first aperture 53 can be threaded (not shown).

Figure 3:
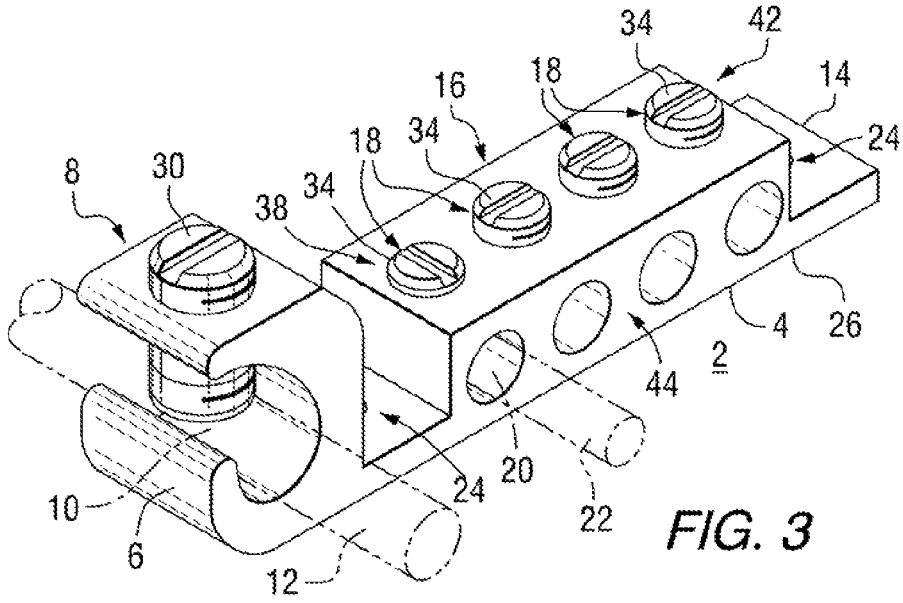
FIG. 3 is a detailed isometric view of the elongated conductive member of FIG. 1, in accordance with certain embodiments of the disclosed concept.
Figure 4:
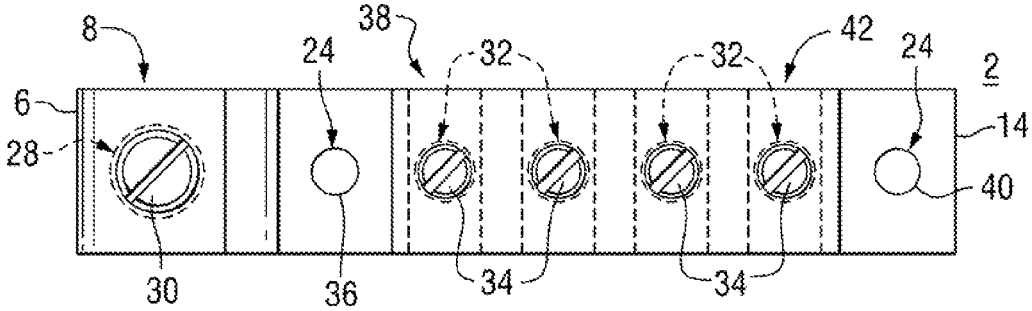
FIG. 4 is a plan view of the elongated, conductive member of FIG. 1, in accordance with certain embodiments of the disclosed concept.
Figure 5:
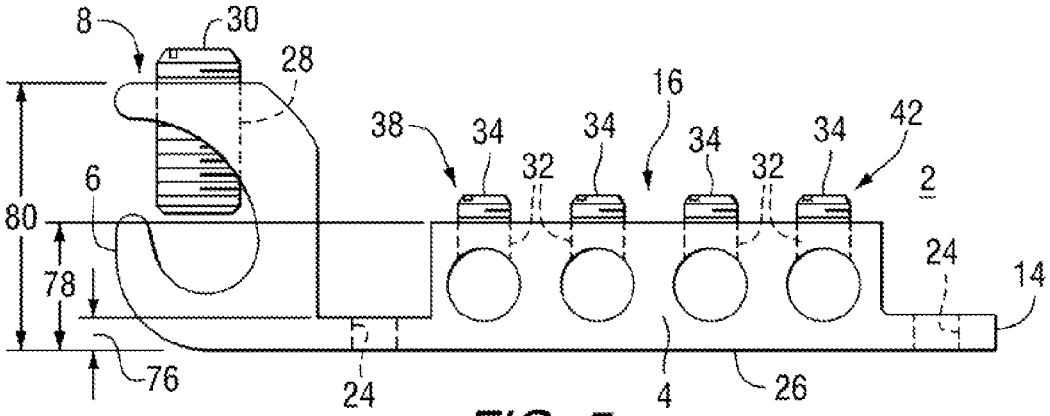
FIG. 5 is a vertical elevation view of the elongated conductive member of FIG. 1, in accordance with certain embodiments of the disclosed concept.

Referring to FIGS. 3-5, the elongated conductive member 2 of FIG. 1 is shown in detail. The elongated conductive member 2 includes a mounting surface 4. The elongated conductive member 2 has a first end 6, an opposite second end 14, and an intermediate portion 16 disposed between the first end 6 and the opposite second end 14. The intermediate portion 16 includes a plurality of lugs 18, each of which is structured to receive and electrically and mechanically engage an end portion 20 of a corresponding one of a plurality of second grounding conductors 22 (as shown in phantom line drawing in FIG. 3 in connection with lug 38) in order that the corresponding conductors 22 extend transverse to the elongated conductive member 2. Each of the plurality of lugs 18 includes a first threaded opening 32 receiving a first threaded screw lug 34.

The intermediate portion 16 further includes a plurality of mounting apertures 24.

The first end 6 includes an open jaw lug 8 structured to receive and electrically and mechanically engage a portion 10 of another grounding conductor 12 (shown in phantom line drawing in FIG. 3). The open jaw lug 8 includes a second threaded opening 28 receiving a second threaded screw lug 30. The open jaw lug 8 can be adjusted to accept a variety of sized conductors. The conductor 12 (shown in phantom line drawing in FIG. 3) extends transverse to the elongated conductive member 2 in a first direction and also transverse to the elongated conductive member 2 in an opposite second direction, in order that the conductor 12 is continuous.

The elongated conductive member 2 includes a planar surface 26. The mounting apertures 24 are disposed through the planar surface 26.

A first mounting aperture 36 of the plurality of mounting apertures 24 is disposed between the open jaw lug 8 and a first lug 38 of the plurality of lugs 18. A second mounting aperture 40 of the plurality of mourning apertures 24 is disposed at the opposite second end 14 of the elongated conductive member 2 and is next to another lug 42 of the plurality of lugs 18.

The intermediate portion 16 is a ground bar 44 including the two example mounting apertures 36,40 and the plurality of lugs 18 disposed along the elongated conductive member 2. Although two mounting apertures 36,40 and four lugs 18 are shown, any suitable counts of mounting apertures and lugs can be employed.

Figure 6:
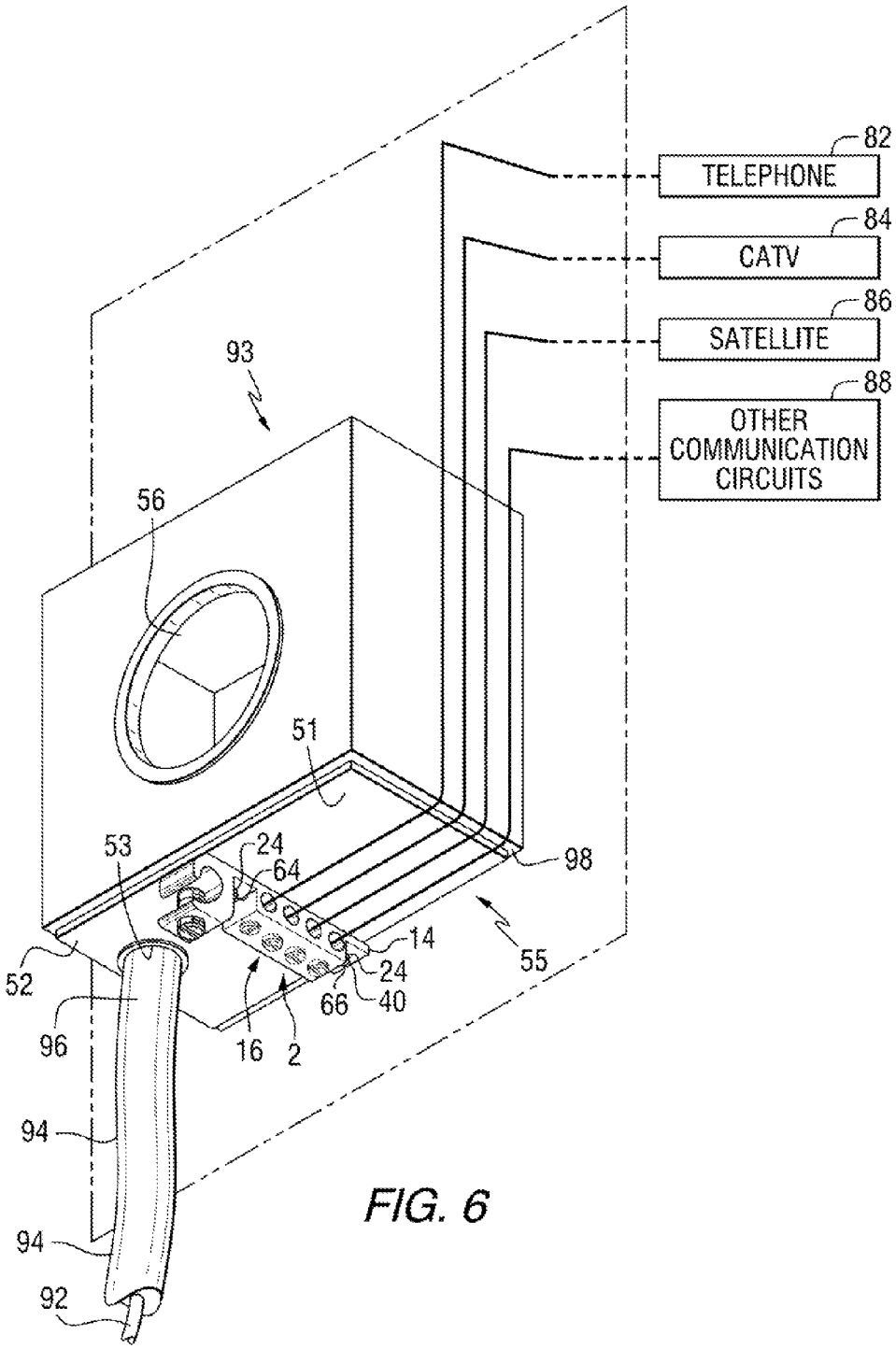
FIG. 6 is an isometric view of a grounding system mounted on a meter enclosure including a grounding apparatus, a mounting substrate, a grounding conductor and an enclosure having a mounting surface in accordance with certain embodiments of the disclosed concept.

FIG. 6 shows the grounding system 55 of FIG. 2 including the elongated conductive member 2 mounted to the substrate 51, the mounting aperture 53 formed in the substrate 51 and structured to receive the end portion 96 of the tube 94 wherein the grounding conductor 92 is disposed. FIG. 6 further includes a meter enclosure 93 on which the grounding system 55 is mounted. The meter enclosure 93 includes an opening 56 for the meter or disconnecting means for additional buildings or structures. Each of a plurality of fasteners 64,66 mounts the intermediate portion 16 of the elongated conductive member 2 to the surface 52 of the substrate 51 at a corresponding one of the mounting apertures 24. The second mounting aperture 40 is disposed at the opposite second end 14 of the intermediate portion 16.

Referring again to FIG. 5, the elongated conductive member 2 has a first thickness 76 above the planar surface 26 at about each of the plurality of mounting apertures 24, a second thickness 78 at the intermediate portion 16, and a third thickness 80 at the open jaw lug 8. The third thickness 80 is greater than the second thickness 78, which is greater than the first thickness 76.

The substrate 51 is mounted to a bottom surface 98 of the meter enclosure 93. In certain embodiments of the invention, the substrate 51 can be mounted to the enclosure 93 employing various fastener mechanisms (not shown) which are known in the art for coupling or connecting a first substrate to the surface of a second substrate. FIG. 6 also shows the elongated conductive member 2 receiving the second grounding conductors 62, 84, 86 and 88.

The grounding system 55 meets the requirements of 2008 NEC Article 250.94 where a central point of termination is employed to connect and bond all systems of a facility. The grounding system 55 ensures a consistent path to ground and makes certain that grounds are the same potential. Otherwise, each of the various systems in a facility has their own separate grounding electrode and, in essence, is a separate system. As a result, the separate systems could have a different resistance to ground due to the lack of commonality. Under 2008 NEC Article 250.94 with the grounding system 55, the separate systems (e.g., without limitation, telephone 82; cable television (CATV) 84; satellite 86; and other communication circuits 88) all have the same grounding point and the same potential.

The grounding system in accordance with the disclosed concept can be employed for residential and commercial facilities. Further, the grounding system is an easy to install means to interconnect and terminate grounding conductors from power, telephone, CATV or radio and television antennas. It may also be used to bond grounding conductors from CATV or satellite dish conductors, security systems, landscape lighting controls and lightning protection systems. The grounding system can include corrosion-resistant materials for construction of the mounting substrate and mounting hardware, such as but not limited to corrosion-resistant stainless steel.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A grounding apparatus for receiving a first grounding conductor and a plurality of second grounding conductors, and for mounting on a meter or a disconnecting means enclosure, comprising:

a substrate having a top surface and a bottom surface;

a first aperture formed in said substrate to receive and electrically and mechanically engage an end portion of the first grounding conductor which extends perpendicular to said substrate; and an elongated conductive member mounted to said top surface of said substrate, comprising:

a first end;

an opposite second end; and an intermediate portion disposed between the first end and the opposite second end, said intermediate portion including a plurality of lugs and, each of said plurality of lugs receives and electrically and mechanically engages an end portion of a corresponding one of the plurality of second grounding conductors, wherein said bottom surface of said substrate is mounted to an exterior surface of the meter or the disconnecting means enclosure.

2. The grounding apparatus of claim 1 wherein said elongated conductive member further comprises a planar surface; and wherein said intermediate portion further comprises a plurality of mounting apertures disposed through said planar surface.

3. The grounding apparatus of claim 1 wherein each of said plurality of lugs has a first threaded opening for receiving a first threaded screw lug.

4. The grounding apparatus of claim 3 wherein said elongated conductive member further comprises an open jaw lug having a second threaded opening for receiving a second threaded screw lug.

5. The grounding apparatus of claim 1 wherein said exterior surface is selected from the group consisting of an exterior top surface, an exterior bottom surface, an exterior back surface, and two exterior side surfaces.

6. The grounding apparatus of claim 5 wherein said substrate is mounted to said exterior bottom surface of said meter enclosure.

7. A grounding system, comprising:

the first grounding conductor having an end portion;

the plurality of second conductors each having an end portion; and a grounding apparatus, comprising:

a substrate having a top surface and a bottom surface;

a first aperture formed in said substrate to receive and electrically and mechanically engage the end portion of said first grounding conductor; and an elongated conductive member mounted to said top surface of said substrate, comprising:

a first end;

an opposite second end; and an intermediate portion disposed between the first end and the opposite second end, said intermediate portion including a plurality of lugs and, each of said plurality of lugs receives and electrically and mechanically engages the end portion of a corresponding one of the plurality of second grounding conductors, wherein said bottom surface of said substrate is mounted to an exterior surface of a meter or a disconnecting means enclosure.

8. The grounding system of claim 7 wherein at least one of said aperture and said end portion has a threaded connector mechanism disposed thereon for electrically and mechanically engaging said end portion into said aperture.

9. A grounding system, comprising:

a first grounding conductor disposed by a tube having an end portion;

a plurality of second conductors each having an end portion; and a grounding apparatus, comprising:

a substrate having a top surface and a bottom surface;

a first aperture formed in said substrate to receive and electrically and mechanically engage the end portion of said tube of said first grounding conductor; and an elongated conductive member mounted to said top surface of said substrate, comprising:

a first end;

an opposite second end; and an intermediate portion disposed between the first end and the opposite second end, said intermediate portion including a plurality of lugs and, each of said plurality of lugs receives and electrically and mechanically engages the end portion of a corresponding one of the plurality of second grounding conductors, wherein said bottom surface of said substrate is mounted to an exterior surface of a meter or a disconnecting means enclosure.

10. The grounding system of claim 9, wherein said elongated conductive member further comprises an open jaw lug having a threaded opening for receiving a threaded screw lug.

* * * * *